United States Patent [19]

Conrad

[11] Patent Number: 4,576,521

[45] Date of Patent: Mar. 18, 1986

[54] PERMANENT MOORING METHOD AND ARRANGEMENT

[76] Inventor: Joseph Conrad, 2929 Campbell St., Kansas City, Mo. 64109

[21] Appl. No.: 567,068

[22] Filed: Dec. 30, 1983

[51] Int. Cl.[4] ..... B63B 21/26; E02D 5/54

[52] U.S. Cl. ..... 405/225; 52/164; 114/293; 114/307; 405/226; 405/244; 405/248

[58] Field of Search ..... 405/224, 225, 226, 228, 405/232, 233, 244, 248; 52/162, 164; 114/293, 294, 295, 301, 304, 307; 204/196, 197; 285/176

[56] References Cited

U.S. PATENT DOCUMENTS

| | | | |
|---|---|---|---|
| 372,940 | 11/1887 | Soden et al. | 174/138 D |
| 454,717 | 6/1891 | Decker | 285/48 |
| 721,663 | 3/1903 | Brooke | 114/304 |
| 744,421 | 11/1903 | Small | 52/162 |
| 825,158 | 7/1906 | Rosseau et al. | 52/164 |
| 1,086,053 | 2/1914 | Howell . | |
| 1,315,721 | 9/1919 | Hall | 114/295 X |
| 1,373,067 | 3/1921 | Goodreau | 114/305 |
| 1,743,431 | 1/1930 | Congable | 285/7 |
| 1,950,947 | 3/1934 | Mulroyan | 285/203 |
| 2,159,116 | 5/1939 | Zacharias | 285/71 |
| 2,229,912 | 1/1941 | Baily | 255/1 |
| 2,334,228 | 11/1943 | Steuermann | 61/35 |
| 2,460,352 | 2/1949 | Jensen | 285/170 |
| 2,583,965 | 1/1952 | Page, Jr. et al. | 61/73 |
| 2,672,322 | 3/1954 | Bodine, Jr. | 255/4.4 |
| 2,703,544 | 3/1955 | Ewing et al. | 114/206 |
| 2,982,244 | 5/1961 | Triechman | 114/208 |
| 3,054,123 | 9/1962 | Moeller | 9/9 |
| 3,118,417 | 1/1964 | Stanwick | 114/206 |
| 3,123,037 | 3/1964 | Jensen | 114/208 |
| 3,130,552 | 4/1964 | Bodine, Jr. | 61/36 |
| 3,187,705 | 6/1965 | Costello et al. | 114/206 |
| 3,207,115 | 9/1965 | Anderson | 114/206 |
| 3,212,110 | 10/1965 | Lombardo | 9/8 |
| 3,215,454 | 11/1965 | Hayes | 285/23 |
| 3,245,223 | 4/1966 | Degen | 61/36 |
| 3,262,412 | 7/1966 | Dantz | 114/206 |
| 3,291,092 | 12/1966 | Halberg et al. | 114/206 |
| 3,295,837 | 1/1967 | Bodine, Jr. | 259/1 |
| 3,311,080 | 3/1967 | Anderson et al. | 114/206 |
| 3,332,387 | 7/1967 | Winslow | 114/208 |
| 3,371,643 | 3/1968 | Dunham | 114/206 |
| 3,408,819 | 11/1968 | Delfosse | 61/35 |
| 3,417,724 | 12/1968 | Edwards | 114/206 |
| 3,604,519 | 9/1971 | Chelminski | 173/1 |
| 3,621,805 | 11/1971 | Smith | 114/208 R |

(List continued on next page.)

*Primary Examiner*—David H. Corbin
*Attorney, Agent, or Firm*—Joseph G. Seeber

[57] ABSTRACT

A permanent mooring method and arrangement for embedding a permanent mooring device in the sea bottom calls for the lowering of the permanent mooring device into the sea until the bottom end contacts the sea bottom, the transmission of fluid under high pressure via a hollow tubular body of the permanent mooring device to a nozzle portion thereof so as to create a fluidized area in the sea bottom around the permanent mooring device and to wash the permanent mooring device into and beneath the sea bottom, followed by transmission of a cementitious substance via the hollow tubular body to the nozzle portion so as to fill the fluidized area in the sea bottom with the cementitious substance. The permanent mooring device is vibrated during transmission of the high-pressure fluid, transmission of the cementitious substance, or consolidation of the cementitious substance, or during any combination thereof to assist in the embedding process. Other features of the invention include: provision of releasable flukes surrounding the tubular portion of the permanent mooring device; the provision of restraints for limiting the outward pivotal movement of the flukes; the provision of primary and secondary nozzles in the tubular portion of the permanent mooring device; the provision of a valve for controlling the flow of high-pressure fluid and/or cementitious substance; provision of a quick-release arrangement between pipe extensions used to lower the device and the tubular portion of the device, once it is embedded; and the provision of a shackle and shackle bar arrangement which is free of electrolytic current flow, and thus less susceptible to corrosion.

29 Claims, 15 Drawing Figures

U.S. PATENT DOCUMENTS

| | | | |
|---|---|---|---|
| 3,653,355 | 4/1972 | Christians et al. | 114/206 A |
| 3,750,609 | 8/1973 | Chelminski | 114/206 A |
| 3,797,255 | 3/1974 | Kammerer et al. | 405/225 |
| 3,817,040 | 6/1974 | Stevens | 61/53.5 |
| 3,850,128 | 11/1974 | Lovell | 114/206 R |
| 3,865,501 | 2/1975 | Kniep | 404/133 |
| 3,910,218 | 10/1975 | Taylor et al. | 114/206 A |
| 4,033,281 | 7/1977 | Lundh | 114/295 |
| 4,080,923 | 3/1978 | Stinnes | 114/304 |
| 4,086,866 | 5/1978 | Nixon | 114/295 |
| 4,095,550 | 6/1978 | Kerr | 114/295 |
| 4,179,878 | 12/1979 | Albertini | 114/293 X |
| 4,216,070 | 8/1980 | Debost | 204/197 |
| 4,312,289 | 1/1982 | Conrad | 114/295 |

PERMANENT MOORING METHOD AND ARRANGEMENT

BACKGROUND OF THE INVENTION

1. Field of the Invention

The present invention relates to a permanent mooring method and arrangement for embedding a permanent mooring device in a sea bottom. More particularly, the invention relates to a method and arrangement wherein fluid is transmitted under high-pressure through a bottom nozzle of a permanent mooring device so as to create a fluidized area in the sea bottom around the permanent mooring device, thus washing the mooring device into and beneath the sea bottom, followed by a transmission of a cementitious substance through the permanent mooring device into the fluidized area of the sea bottom, thus filling that area in the sea bottom with the cementitious substance. Subsequently, the cementitious substance consolidates around the permanent mooring device. Vibration is utilized, during one or more of the various steps of the procedure, to assist in establishment of the permanent mooring.

2. Description of the Prior Art

In recent years, the necessity for establishment of permanent moorings has increased. For example, the increase in the popularity of the sport of boating has resulted in less space being available to moor boats in marinas, and accordingly, due to the insufficient dockage, it has become the practice to moor boats in small bays, inlets, estuaries, or the like, located adjacent to the dock areas of yacht clubs and marinas.

In addition, the increase in large-scale off-shore activities, such as off-shore oil exploration, has increased the need for permanent moorings of extremely high strength. Such extremely strong permanent moorings are necessary, for example, in the stabilization of off-short oil drilling platforms.

Early attempts to achieve permanent moorings consisted of the positioning, along the sea bottom, of large blocks of concrete with eyelets embedded therein. Such techniques had various disadvantages, and the present inventor has previously presented in U.S. Pat. No. 4,312,289, issued on Jan. 26, 1982, a description of the disadvantages of the earlier prior art techniques, as well as a disclosure of a permanent mooring apparatus having significant advantages over the earlier techniques.

The permanent mooring apparatus disclosed in the aforementioned patent was preferably formed of metal and had foldable flukes. The previously disclosed mooring was intended to be driven into the sea bottom by means of water pressure emitted from a nozzle at the lower end of the device, and by downward force applied to pipe sections, by means of which the permanent mooring had been lowered to the sea bottom. According to the previously disclosed technique, once the permanent mooring was washed into and beneath the sea bottom to a sufficient depth, the water pressure was discontinued, and any attempt to retract the permanent mooring from the sea bottom resulted in unfolding of the flukes which then grasped the sea bottom, thus creating a permanent mooring.

Such a permanent mooring apparatus as was disclosed in the aforementioned patent had some disadvantages. For example, the device did not attain its full holding capacity because of the liquefaction of the sea bottom caused by the constant pulls exerted upon it by the surface vessel, especially if the device was utilized for large-scale applications. Thus, this ineffectiveness resulted from the fact permanent mooring previously disclosed relied, for its strength and resistance, merely on its ability to grasp the surrounding medium making up the sea bottom, and that medium can be very loose and fluid in places.

In addition, the previously disclosed procedure for establishing the permanent mooring was time-consuming due to the fact that only a combination of transmission of high-pressure fluid through the permanent mooring device and downward pressure on the pipe sections connected to the top of the mooring device was employed for the purpose of washing the device into the sea bottom.

Various other patents (in addition to the inventor's previous patent) have disclosed techniques involving the fluidization of the sea bottom to assist in the embedment of an anchor or mooring: U.S. Pat. Nos. 3,408,819; 4,086,866; 4,095,550; and 4,347,802. Other patents have disclosed techniques utilizing vibration for the purpose of embedding an anchor in the sea bottom, for example: U.S. Pat. Nos. 3,118,417; 3,417,724; and 3,850,128. Still other patents have disclosed techniques involving action-reaction phenomena induced for the purpose of embedding the anchor in the sea bottom, for example: U.S. Pat. Nos. 3,371,643; 3,604,519; and 3,750,609, Further patents disclose the use of vibration techniques in applications other than anchor embedment, for example: U.S. Pat. Nos. 2,334,228; 2,672,322; 3,245,223; 3,295,837; and 3,865,501.

Furthermore, the prior art technology has included various attempts to establish permanent moorings both within the sea bottom and within earth formations. For example, the following patents are typical: U.S. Pat. Nos. 721,663; 1,086,053; 1,315,721; 1,373,067; 2,229,912; 3,123,037; 3,130,552; 3,207,115; 3,262,412; 3,332,387; 3,653,355; 4,033,281; and 4,080,923.

Other prior art techniques involve the use of explosive charges to drive a mooring device into the sea bottom, but such techniques are expensive and requiring mooring devices which are complicated and/or not self-contained.

The following patents are of background interest with regard to the presently disclosed invention: U.S. Pat. Nos. 372,940; 454,717; 1,743,431; 1,950,947; 2,159,116; 2,460,352; 2,583,965; 2,703,544; 2,982,244; 3,054,123,3,187,705; 3,212,110; 3,215,454; 3,291,092; 3,311,080; 3,621,805; 3,817,040; 3,910,218; and 4,345,785.

SUMMARY OF THE INVENTION

The present invention relates to a permanent mooring method and arrangement for embedding a permanent mooring device in a sea bottom.

More particularly, the method and arrangement of the present invention relate to the provision of a permanent mooring device having a hollow tubular body, with a nozzle portion located at the bottom end of the tubular body. The permanent mooring device is lowered into the sea until the bottom end of the device contacts the sea bottom, at which point fluid is transmitted under high-pressure, via the hollow tubular body, to the nozzle during a first time interval so as to create a fluidized area by means of fluidization of the sea bottom around the permanent mooring device. As a result, the permanent mooring device is washed into and beneath the sea bottom.

Once the permanent mooring device is washed into the sea bottom, a cementitious substance is transmitted, via the hollow tubular body, to the nozzle during a second time interval so as to fill the fluidized area in the sea bottom with the substance. Upon cessation of transmission of the cementitious substance into the fluidized area, the substance consolidates around the permanent mooring device, thus creating a permanent mooring.

In accordance with an important feature of the present invention, the permanent mooring device is vibrated during either the transmission of fluid under high pressure, the transmission of the cementitious substance, or the consolidation of the substance in the fluidized area, or during any combination of those stages, so as to assist in the establishment of the permanent mooring.

In particular, vibration of the permanent mooring device during fluidization of the sea bottom assists in washing the permanent mooring device into and beneath the sea bottom. Vibration of the permanent mooring device during introduction of the cementitious substance assists in the homogenization of the cementitious substance during transmission thereof to the nozzle of the hollow tubular body. Vibration of the permanent mooring device after the transmission of the cementitious substance has been halted assists in settling of the cementitious substance as it consolidates around the permanent mooring device. Thus, the overall result of the above-described technique is an increase in the efficiency with which the permanent mooring is established.

A further feature of the present invention involves the provision of the permanent mooring device with releasable flukes foldably attached to the device and arranged to pivot outwardly from a folded position to an extended position surrounding the permanent mooring device. Once the permanent mooring device has been embedded in the fluidized area created by the fluidization technique, the flukes are released from their folded position and assume the extended position surrounding the permanent mooring device. This increases the overall strength and resistance of the permanent mooring device.

In accordance with further features of the invention, each of the flukes has associated with it a corresponding restraining bar or chain which limits the outward pivotal movment of the fluke into its extended position; in the case of the restraining bar, each bar may be provided with two portions connected together in hinge-like fashion so that the restraining bars are in a folded position when the flukes are in their folded position, prior to extension. The latter features result in increased strength and resistance of the permanent mooring device, as well as maintenance of compactness of the device during the time when it is being lowered to the sea bottom and embedded into the sea bottom (that is, prior to fluke extension).

In order to assist in the embedding process, the hollow tubular body of the permanent mooring device is provided, at its lower end, with at least one primary nozzle through which high-pressure fluid (as well as the cementitious substance) is pumped, and also with at least one secondary nozzle located on the hollow tubular body above the primary nozzle, thus providing a secondary means for fluidizing the sea bottom (and filling the fluidized area with cement), and thus dispersing the liquid cement more evenly throughout the medium into which the device is being washed, that medium acting as the aggregate that, with the cement, forms concrete.

Since the method and arrangement of the present invention call for a fluidization stage (during which high-pressure fluid is pumped through the hollow tubular body of the device), followed by a further stage during which a cementitious substance is pumped through the hollow tubular body, a further feature of the invention facilitates the transition from one stage to the other. Specifically, the permanent mooring arrangement is provided with a valve associated with the high-pressure fluid source and cementitious substance source for selectively starting or stopping the flow of the high-pressure fluid and the cementitious substance, respectively.

In accordance with a further feature of the invention, in order to improve overall efficiency, a "quick release" technique is provided so that, once the permanent mooring device is permanently embedded in the sea bottom, the series of pipe sections, by means of which the device was initially lowered into the sea bottom, can be quickly released from the device, and retrieved by the mooring personnel on the surface.

Prior to a permanent mooring device being established in the sea bottom, it is typically required that a mooring chain or other similar line (known as a "rode") be connected between the permanent mooring device itself and a floating device, such as a buoy. In accordance with a further feature of the invention, the permanent mooring device is provided with dielectric insulators arranged to prevent electrolytic or corrosive current from flowing between the permanent mooring device and the rode.

Therefore, it is an object of the present invention to provide a permanent mooring method and arrangement for embedding a permanent mooring device in and beneath the sea bottom.

It is another object of the present to provide a permanent mooring method and arrangement involving the transmission of high-pressure fluid through the device to wash the device into and beneath the sea bottom, followed by transmission of a cementitious substance through the device into a fluidized area created by the high-pressure fluid.

It is another object of the present invention to provide a permanent mooring method and arrangement, in which the permanent mooring device is vibrated during the wash-in stage, the cementing stage, or the consolidating stage, or a combination thereof.

It is another object of the present invention to provide a permanent mooring method and arrangement in which foldable flukes are released during the wash-in and/or the cementing stages.

It is an additional object of the present invention to provide a permanent mooring method and arrangement including a quick-release technique for releasing pipe sections (employed in lowering the device initially) from the device once it is embedded in the sea bottom.

It is an additional object of the present invention to provide flukes arranged in different tiers at different levels of the device.

It is an additional object of the present invention to provide the device with primary and secondary nozzles for emission of the high-pressure fluid and/or the cementitious substance.

It is an additional object of the present invention to provide a permanent mooring method and arrangement wherein valve means are employed for selectively starting and/or stopping the flow of high-pressure fluid or cementitious substance.

It is a further object of the present invention to provide a permanent mooring method and arrangement wherein the permanent mooring device is provided with dielectric insulators to preclude the flow of electrolytic (corrosive) current between the device and the rode.

The above and other objects that will hereinafter appear, and the nature of the invention will be more clearly understood by reference to the following description, the appended claims, and the accompanying drawings.

DETAILED DESCRIPTION

Prior to describing the inventive permanent mooring device, arrangement and method in detail, a detailed description of the permanent mooring device of the prior art is appropriate.

Figure 1:
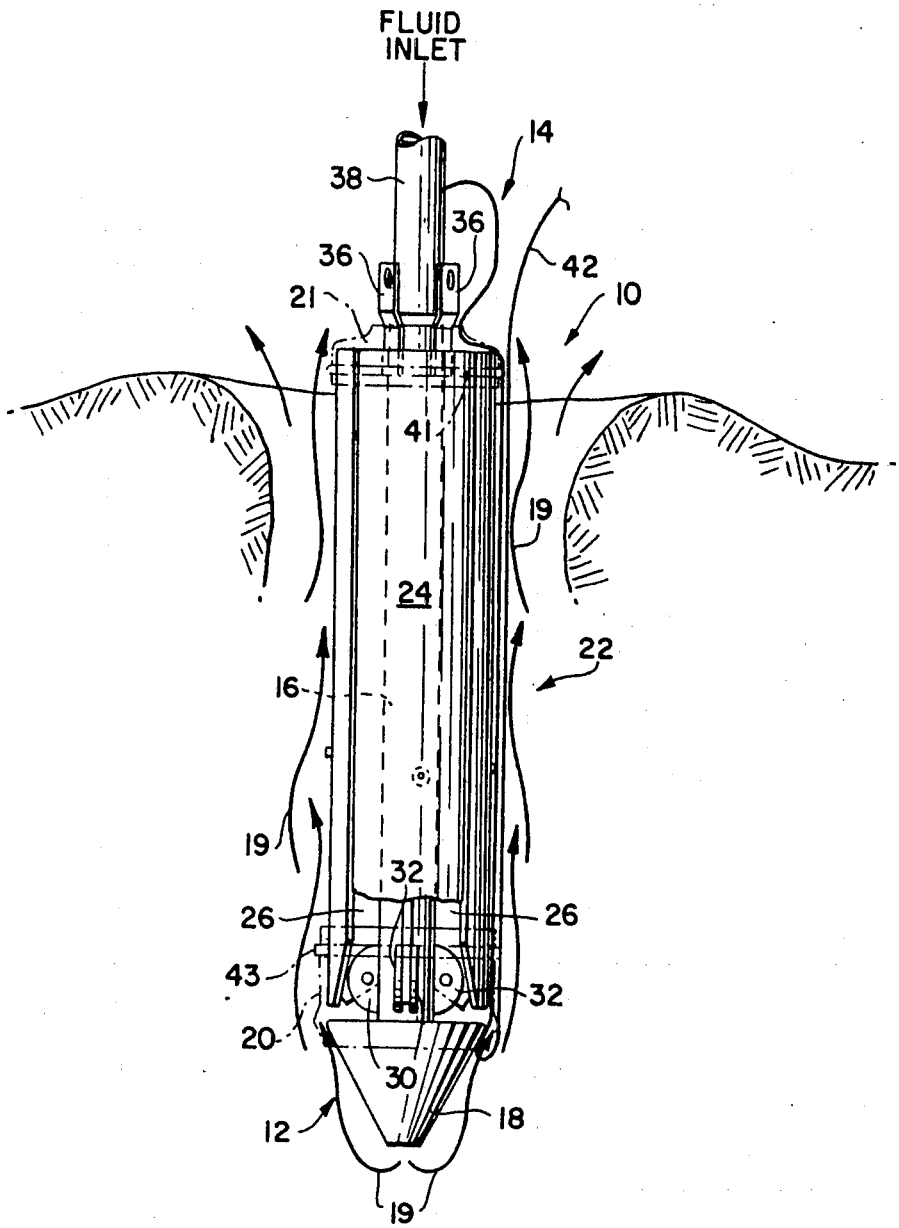
FIG. 1. (PRIOR ART)
FIG. 1 is a side elevation view of a permanent mooring device of the prior art, with flukes in a folded position.
Figure 2:
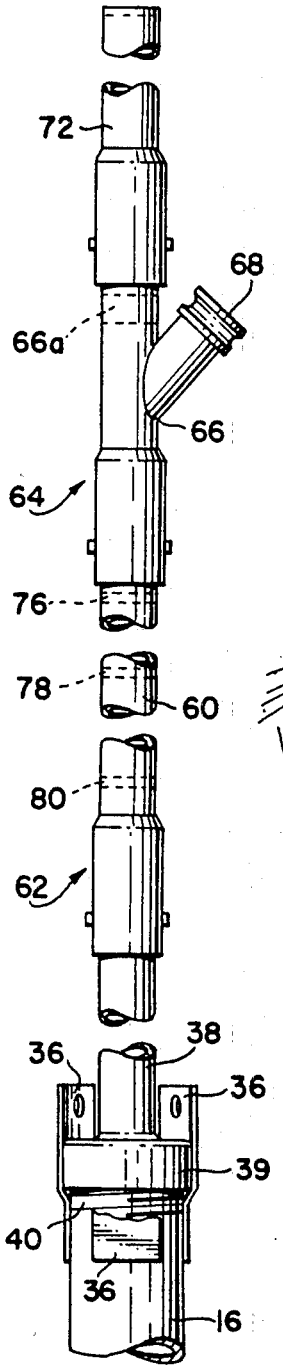
FIG. 2. (PRIOR ART)
FIG. 2 is a side elevation view showing a supply pipe and its connection to a permanent mooring device of the prior art.
Figure 3:
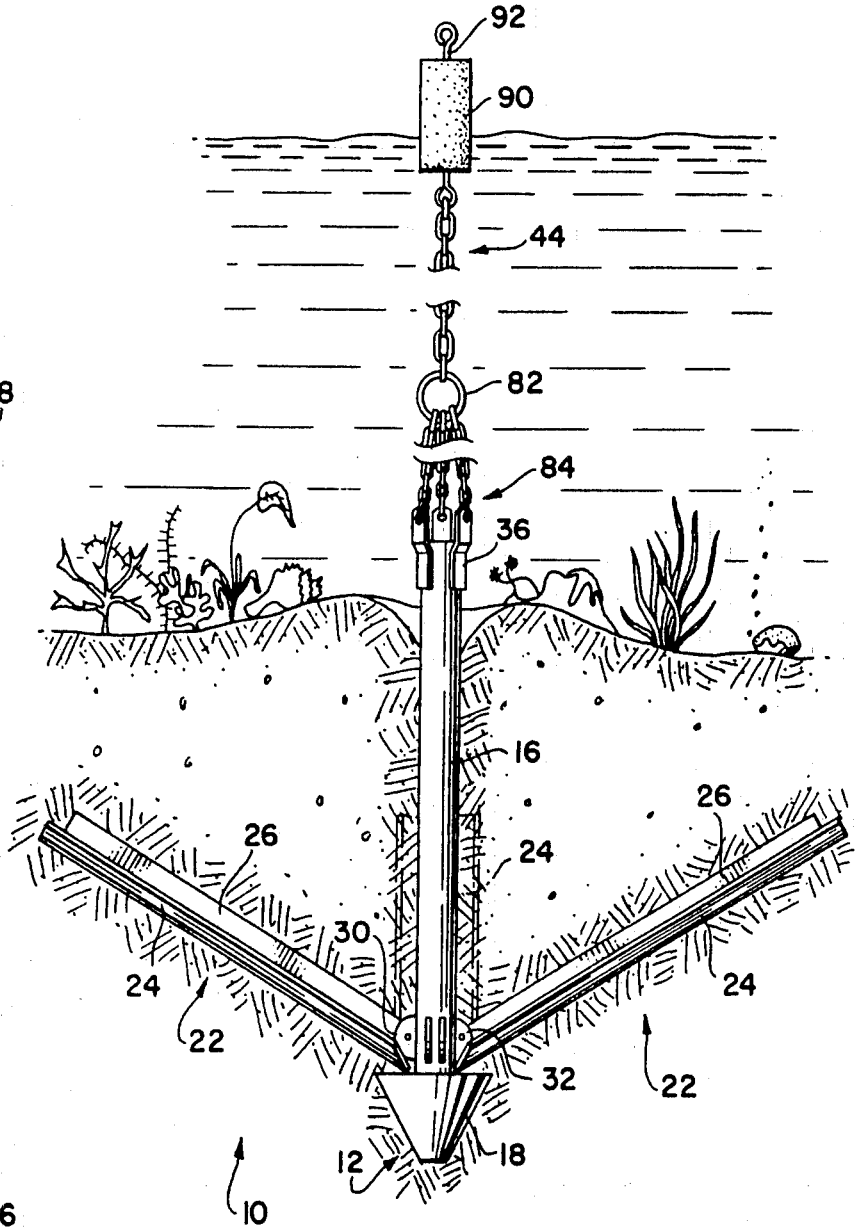
FIG. 3. (PRIOR ART)
FIG. 3 is a side elevation view, in diagrammatic form, of a permanent mooring device of the prior art, as positioned in the sea bottom.

A detailed description of the permanent mooring device of the prior art will now be undertaken, with reference to FIG. 1 which is a side elevation view of the permanent mooring device of the prior art, FIG. 2 which is a diagrammatic representation of the connection of a supply pipe to the permanent mooring device of the prior art, and FIG. 3 which is a side elevation view of the permanent mooring device of the prior art, as embedded in the sea bottom.

Referring to FIG. 1, the permanent mooring device 10 comprises the following basic elements: a tip or nozzle portion 12 including a nozzle 18 for discharging high-pressure fluid and embedding the device into the sea bottom; a fluid inlet system 14 for connection to a source of high-pressure fluid; and a tubular body portion 16.

The fluid inlet system 14 consists of a supply pipe 38 threadably engaged or coupled to the tubular body portion 16 of the device 10.

The device 10 also comprises foldable flukes 22, the embodiment shown employing four such flukes. A typical fluke consists of a concave blade-like portion 24 and a main arm or body portion 26. The concave blade 4 is a portion of a cylinder and, when the blades are folded, they form a cylindrical shell around the mooring to aid in penetrating the sea bottom. Each fluke 22 is attached to the main body 16 by two parallel mounting plates 30 and 32. The main arm or body portion 26 of each fluke 22 is arranged between its respective mounting plate 30, 32 and is pivotally held there by means of a pin or axle.

At the top of the tubular body portion 16, three shackle bars 36 are positioned, so that a mooring line or chain (a rode) can be connected to the three shackle bars 36. It is to be noted that, in this prior art device, the shackle bars 36 are in the form of flat bars with holes contained in the upper portion thereof, the holes being provided for the purpose of connection to the mooring line or chain (not shown). As mentioned previously, such a prior art device, and its shackle arrangement in particular, are prone to electrolytic corrosion resulting from the flow of electrolytic current between the mooring device 10 and the mooring line or chain, especially when the mooring line or chain is made of one type of material (such as stainless steel) and the device 10 is made of another type of material (such as steel).

Referring to FIG. 2, it is to be understood that the supply pipe 38 can be welded to a flange 39 which is threadably engaged with the pipe 38 at the point 40. However, this results in another disadvantage of prior art arrangements, in that it precludes rapid release of the mooring device (that is, disconnection of the supply pipe 38 from the tubular body portion 16 of the device 10) once the permanent mooring device 10 is in place in the sea bottom.

One prior art solution to this problem is exemplified by the arrangement shown in FIG. 2. In this embodiment of the prior art, the supply pipe 38 is welded to the flange 39, which is screwed into the top of the tubular body portion 16 at point 40 in essentially a sealing-type engagement. Since it was considered desirable to have a relatively quick release capability, releasing the pipe 38 and flange 39 from engagement with the permanent mooring device 10, it was determined that a thread having an exceptionally quick release capability (that is, a coarse thread, such as those used in well drilling or those used in making soil percolation tests) was desirable.

Referring to FIG. 3, the flukes 22 were, in the prior art, provided with spring-actuated plungers (not shown in the figure), and the flukes were retained in the folded position by means of a plastic band or strap (also not shown). Once the device 10 was washed into the sea bottom, the band or strap was to be broken by pulling on a tension cable or the like, and the spring actuated the flukes to the open position, as can be seen by referring to the flukes 24, 26 of FIG. 3.

Referring to FIGS. 1, 2 and 3, operation of the permanent mooring device 10 of the prior art proceeded as follows. The device 10 was pointed toward the sea bottom from the work boat, and was lowered using various pipe sections 60, 72, etc. It is to be noted that extension 60 has a Y-shaped fitting 66 having an inlet 68 to which a feed hose can be connected for the purpose of transmitting high-pressure fluid to the supply pipe 38. It should also be noted that a plug 66*a* is inserted into the top portion of fitting 66 so as to prevent fluid from rising through any other extensions located above that point.

Further describing the operation of the mooring device 10, upon contact of the sea bottom by the nozzle portion 12 (FIG. 3), high-pressure water is fed through the inlet 68 and the supply pipe 38, so as to pass down through the tubular body portion 16, and to be emitted from the nozzle portion 12, as indicated by the arrows 19 (FIG. 1). This is all occurring while the operator on the surface is exerting a downward force on the pipe sections connected to the supply pipe 38, and the operator at the surface can determine when the permanent mooring device 10 has been embedded sufficiently into the sea bottom by monitoring markings, such as markings 76, 78 and 80 (FIG. 2), or markings on the pipe sections connected to the supply pipe 38.

According to the prior art technology, once the operator determined that the sea bottom had been sufficiently penetrated by the device 10, the operator would pull the wire or cable 42 (FIG. 1) so as to release the bands 41 and permit the spring-loaded flukes 22 to pivot into their extended position. Referring to FIG. 3, further pulling by the operator on the mooring chain 44 attached to the shackle bars 36 would force the flukes 22 into a further extended position, the flukes 22 being further forced into this position by pressure from the sea bottom medium which had, by this time, settled around the device 10.

Further referring to FIGS. 1 and 3, it can be seen that the transmission of high-pressure fluid through the supply pipe 38 and out of the nozzle portion 12 causes the permanent mooring device to embed itself into the sandy or muddy bottom by means of downward pressure on the supply pipe 38, in combination with the washing action of the high-pressure fluid which forces the sand, mud, silt and the like to rise over the surface of the tubular body portion 16 as shown by arrows 19, thereby acting as a lubricant during the embedding process. Nevertheless, as previously mentioned, once the device 10 is embedded in the sea bottom, as seen in FIG. 3, only the downward pressure or resistance to disturbance of the surrounding sand, mud or silt will retain the device 10 in place, thus making for a somewhat weaker permanent mooring.

Figure 4:
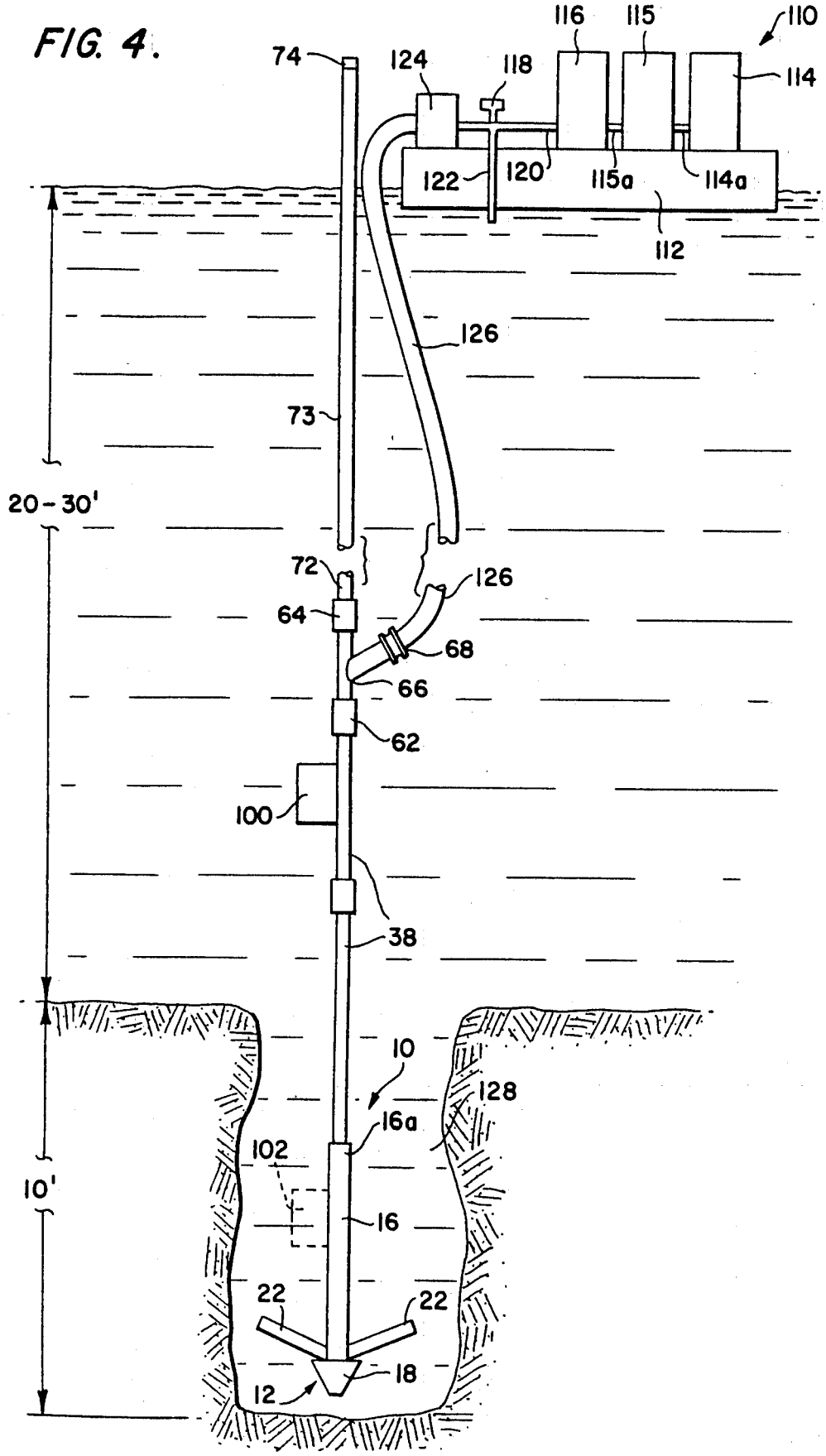
FIG. 4 is a side elevation view, in diagrammatic form, of the permanent mooring arrangement of the present invention.

FIG. 4 is a side elevation view of the permanent mooring arrangement of the present invention. Where appropriate, reference numerals identical to those employed in FIGS. 1–3 have been retained in FIG. 4.

As seen in FIG. 4, the device 10 comprises a tubular body portion 16 having flukes 22 and a nozzle portion 12 (with nozzle 18). A supply pipe 38, releasably connected at one end to the tubular body portion 16, is connected at its other end to pipe extensions 72, 73 via couplings (such as vacuum cleaner-type couplings) 62, 64. A vibrator 100 is attached to pipe 38 by conventional hose clamps, and/or a vibrator 102 may be connected to tubular body portion 16.

In accordance with the inventive method, a working platform 110 is situated on the surface of the water over that position, on the sea bottom, at which a permanent mooring device 10 is to be located. The working platform 110 comprises a raft 112, on which containers 114–116 of cementitious substance are carried. Preferably, containers 114, 115 and 116 are mutually connected by pipes 114*a* and 115*a* so that the containers 114–116 are emptied in tandem.

The third container 116 is connected by a pipe 120 to a pump 124, the pipe 120 being connected to pipe 122 in T-fashion, the pipe 122 being connected to a source of fluid, such as the sea water itself. Furthermore, a valve 118 is provided at the junction of the pipes 120 and 122 so as to selectively start or stop flow of fluid (sea water) via pipe 122 and cementitious substance from containers 114–116 via pipe 120.

The pump 124 is connected via line or hose 126 to the inlet 68 provided in the Y-connection 66 of the supply pipe extension 60.

With respect to the operation of the arrangement of FIG. 4, operation basically proceeds as previously described with respect to the prior art arrangement, until such time as the device 10 is embedded in the sea bottom, that is, has penetrated a fluidized area 128 to a sufficient depth. More specifically, personnel on the platform 110 lower the device 10 via its supply pipe 38, as well as any extensions 72, 73 which are necessary in order to reach the desired depth (in the example of FIG. 4, 20–30 feet). Once the bottom of the sea is contacted, valve 118 is operated to permit water flow from pipe 122 to the pump 124, and pump 124 pumps sea water via lines 122 and 126, inlet 68, supply pipe 38 and tubular body portion 16 to the nozzle portion 12 of the device 10. As was the case in the prior art embodiment, water flowing from the nozzle portion 18 fluidizes the sea bottom and forms a fluidized area 128 therein.

In accordance with one aspect of the present invention, a vibrating unit 100 may be positioned on pipe 38, in which case it will be retrievable with pipe 38 once the device 10 is embedded. Alternatively, a vibrating unit 102 may be positioned on the tubular portion 16, but this must be a disposable vibrating unit. Use of vibrating units 100 and/or 102 facilitates embedment of the device 10 in and beneath the sea bottom.

Once the mooring device 10 has reached a desired depth (that is, a depth of, for example, ten feet), pumping of sea water can be halted by actuating valve 118 to permit flow from pipe 120 to pump 124. The pump 124 then pumps cementitious substance from the containers 114–116, via line 126, inlet 68, supply pipe 38, and tubular body portion 16, to the nozzle 18, from which it is expelled from the device 10 and fills up the fluidized area 128.

It is to be noted that, in accordance with the invention, during the transmission of cementitious substance to the fluidized area 128, the vibrating units 100 and/or 102 can be utilized to ensure that the cementitious substance remains homogenized during its transmission along the aforementioned path.

Once the area 128 is adequately filled with cementitious substance, as determined by (for example) timing the flow of the substance through the aforementioned path, the pump 124 can be stopped and the valve 118 closed, and the cementitious substance will be permitted to solidify around the device 10. In accordance with the present invention, during this stage of the process, the vibrators 100 and/or 102 can again be employed, but this time to consolidate the fluidized medium, including the cementitious substance, surrounding the device 10 in the fluidized area 128.

It is to be understood that the supply pipe 38 and pipe extensions 72, 73, etc. can be retrieved in the same manner that they were retrieved in the prior art technology. However, as mentioned previously, certain disadvantages attach to the prior art technique. Accordingly, in order to overcome one of these disadvantages—that is, the disadvantage of excessive time consumption in retrieving the pipe sections—the present invention provides a quick-release feature which will be described in more detail subsequently, with reference to FIGS. 9, 10A and 10B.

It is also to be understood that the containers 114–116 may be filled with any cementitious substance or other chemical substance used as an adhesive or as a solidifying agent. For example, such cementitious substances as Portland cement may be utilized. Similarly, such solidifying agents as acrylic compounds, or any other solidifying agents especially useful for under water setting, may be utilized.

Finally, with reference to FIG. 4, it is to be noted that the diagrammatic representation set forth therein is not intended to be drawn to scale, and that the dimensions of water depth and depth of area 128 are merely for illustrative purposes.

Figure 5:
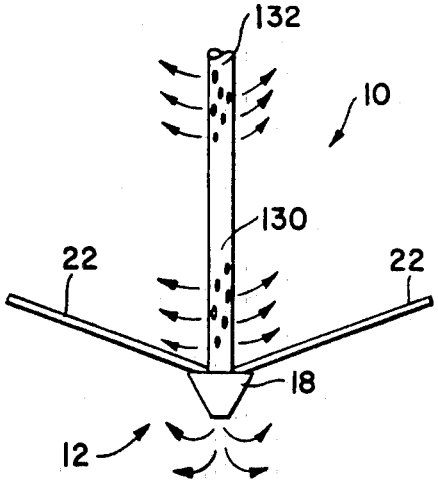
FIG. 5 is a side elevation view of the permanent mooring device, with primary and secondary nozzles, of the present invention.

FIG. 5 is a side elevation view of the permanent mooring device in accordance with the present invention. As seen in FIG. 5, the nozzle portion 12 includes the primary nozzle 18 (previously shown in the prior art embodiment of FIG. 1), but also includes secondary nozzles 130 and 132, consisting of nozzle holes contained in the tubular portion of the device 10.

Figure 6:
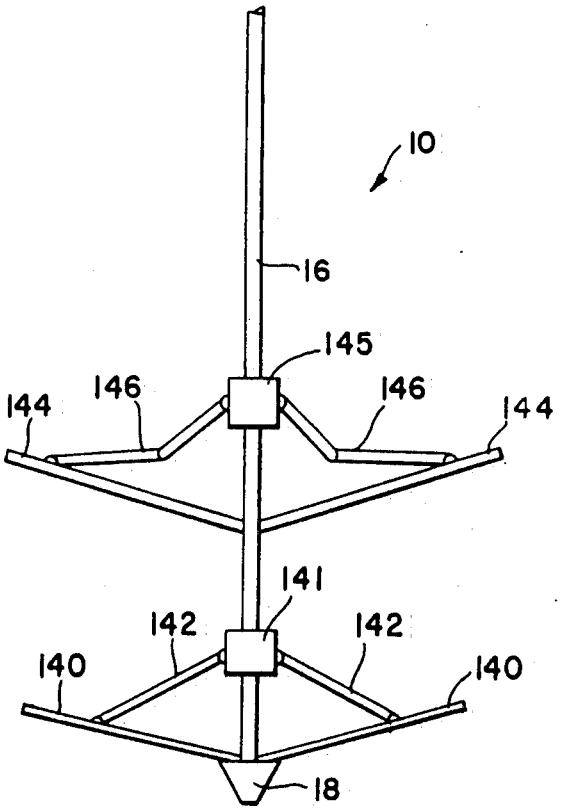
FIG. 6 is a side elevation view, in diagrammatic form, of the permanent mooring device, with tiered flukes and restraining devices, of the present invention.

In accordance with the present invention, the use of primary and secondary nozzles 18 and 130, 132, respectively, results in more efficient washing of the device 10 into the sea bottom (in contrast to the less efficient "washing in" process of the prior art techniques), and also more efficient filling of the area 128 (FIG. 4) with cementitious substance FIG. 6 is a further side elevation view of the device 10 of the present invention, and is used to illustrate the formation of a plurality of flukes 140, 144, etc. in tiers, as well as the provision of restraining bars 142 and/or hinged restraining bars 146 for limiting the outward pivotal movement of the flukes 140 and 144, respectively, during the embedding process. As seen in FIG. 6, the restraining bars 142 are connected to a movable sleeve 141 located in concentric arrangement with respect to the tubular portion 16 of the device 10, while the foldable or hinged restraining bars 146 are connected to a similarly arranged sleeve 145. As previously indicated, the restraining bars 142, 146 can be replaced with chains connected between sleeves 141, 145 and flukes 140, 144.

By arranging the flukes 140 and 144 in tiers, the present invention is able to achieve a higher degree of strength and resistance for the permanent mooring device 10, as contrasted with the lower strengths of prior art devices. Moreover, the provision of restraining bars (or chains) 142 and 146 not only insures that the flukes 140 and 144 pivot or extend to their proper position with respect to the tubular portion 16, but also provides additional supporting strength once the permanent mooring device 10 is embedded in place, resulting in far higher resistance to disturbance forces which might be exerted on the device 10 via the mooring line or chain connected thereto.

FIGS. 7A thru 7D depict the shackle and shackle bar arrangement of the present invention. The prior art permanent mooring arrangement and technique call for the device 10 and flat shackle bars 36 (FIG. 3) to be formed of steel because steel is cheap and is a most appropriate material from which to form these elements. Moreover, such techniques call for the mooring chain or rode 44 and shackles or chains 84 to be formed of stainless steel, a very hard metal and one which avoids the wearing action of sand due to movement of the moored vessel, grinding of sand between the chain links, and the like.

However, since steel and stainless steel are dissimilar metels, electrolytic current will flow therebetween, and this will result in corrosion of the steel mooring device 10 and shackle bars 36.

Figure 7A:
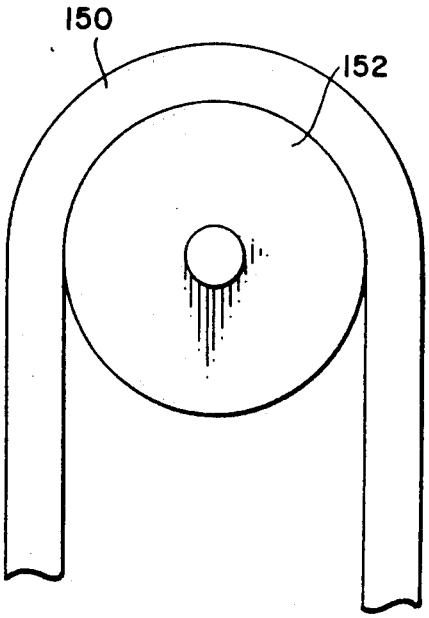
FIGS. 7A and 7B are a side elevation view of the shackle bar and dielectric insulator, and a front view of the shackle bar and dielectric insulator in combination with the shackle and pin connector, respectively, in one embodiment of the present invention.
Figure 7B:
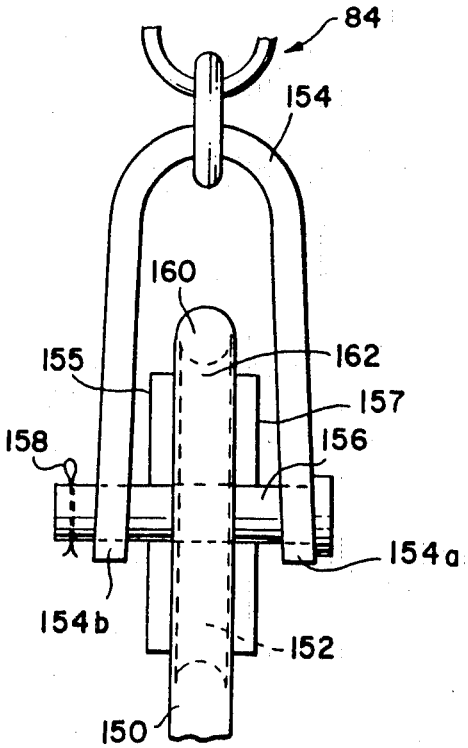
Figure 7C:
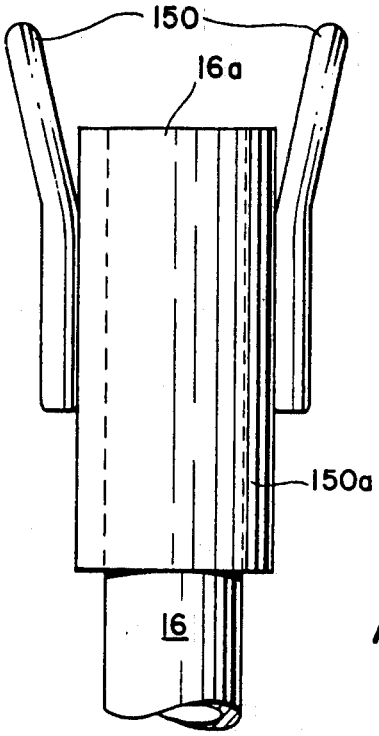
FIGS. 7C and 7D are front and side views, respectively, of the shackle bars connected to the mooring device.
Figure 7D:
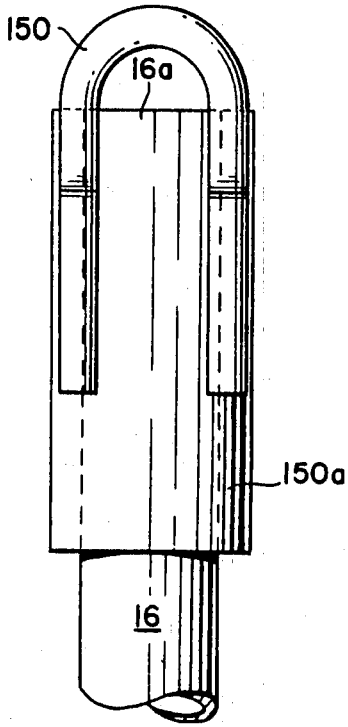

In order to avoid the electrolytic current flow and resultant corrosion, the present invention calls for the replacement of the flat shackle bars 36 with two (preferably two) curved or rounded shackle bars 150 (shown in FIGS. 7C and 7D) disposed in opposition to each other on opposite sides of the top portion **16*a* of tubular body portion 16, and (referring to FIGS. 7A and 7B) the linkage of the shackle bars 150 to respective curved shackles 154 via respective dielectric insulators 152 disposed between respective shackle bars 150, on the one hand, and respective pin connectors 156 connected to (inserted through the end portions of) respective shackles 154, on the other hand. More specifically, the shackle bar 150 is connected at its ends (via welded sleeve 150*a*) to top portion 16*a* of tubular body portion 16 of the device 10 (FIGS. 7C and 7D), and has a rounded portion or cross section 160, while the disc-shaped dielectric insulator 152 has an inwardly curved peripheral portion 162 (FIGS. 7A and 7B). The outwardly curved portion 160 of shackle bar 150 fits perfectly within the inwardly curved portion 162 of the dielectric insulator 152 in interlocking fashion. Pin 156 is then inserted through the center of the dielectric insulator 152 at the same time that it is inserted through the end portions 154*a* and 154*b* of the shackle 154, and pin 156 is locked in place by locking pin 158 as shown. Thus, the shackle bar 150 and shackle 154 are linked via the dielectric insulator 152. It is, of course, to be understood that the spaces between the end portions of the shackle 154 and the shackle bar 150/dielectric insulator 152 will be filled with some sort of dielectric supporting material 155, 157** so that the overall arrangement is tightly locked into an integral piece.

As a result of this feature of the invention, electrolytic current flow between the tubular body 16 and the shackle chains 84 (FIG. 7B) is precluded by the dielectric insulator, so that corrosion of the device 10 and rode 44 (FIG. 3) is precluded or at least reduced in the present invention.

Figure 7E:
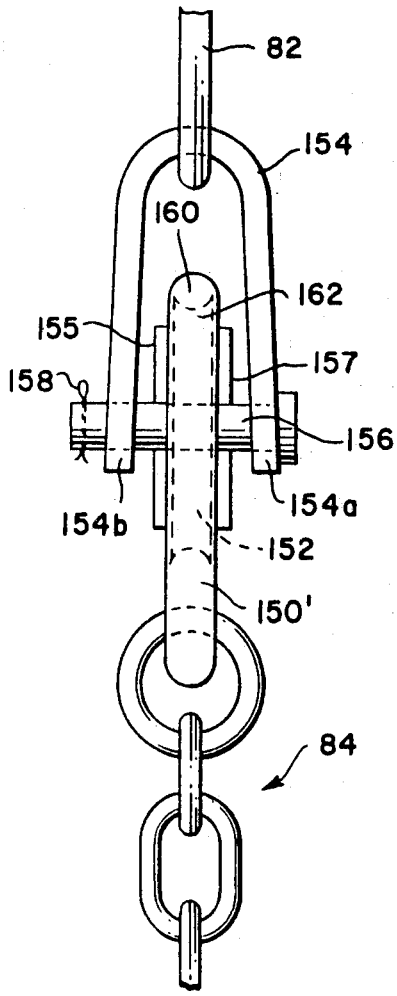
FIG. 7E is a front view of the shackle bar/dielectric insulator/shackle/pin connector arrangement of the invention.

Referring to FIG. 7E, it should be noted that, as an alternative or additional anti-corrosive technique, the same basic insulator arrangement could be employed to insulate the rode ring 82 and the shackle chains 84. The top links of shackle chains 84 (only one shackle chain is shown for simplicity) are looped around a rounded (closed loop) shackle bar 150', while the rode ring 82 is looped around shackle 154, and electrolytic current flow between chains 84 and ring 82 is precluded.

Figure 8:
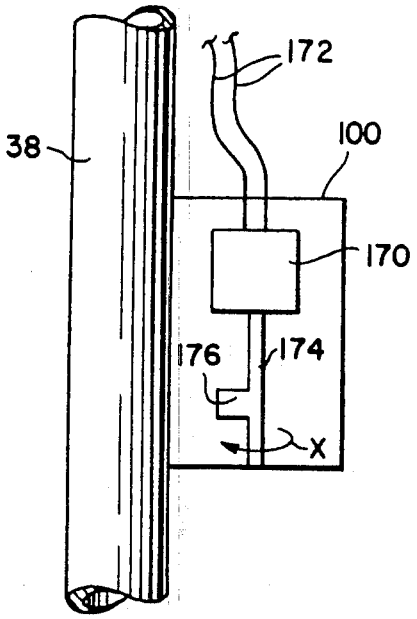
FIG. 8 is a detailed diagrammatic representation of the vibrator associated with the permanent mooring device of the present invention.

FIG. 8 is a diagrammatic representation of the vibrating unit 100 employed in accordance with the present invention, in association with supply pipe 38, or alternatively tubular portion 16 of the device 10. Whereas any type of vibrating unit (such as a sonic vibrator) can be employed, the vibrating unit 100 is preferably a mechanical vibrating unit including a motor 170 to which there is connected a shaft or rod 174. The shaft or rod 174 is driven in a given direction (for example, as indicated by the arrow X in FIG. 8), and has a protrusion or extension 176 located thereon. As a result of rotation of the shaft 174 with its protrusion 176 by the motor 170, vibratory force is imparted to the pipe 38 (or, alternatively, to the tubular portion 16).

Figure 9:
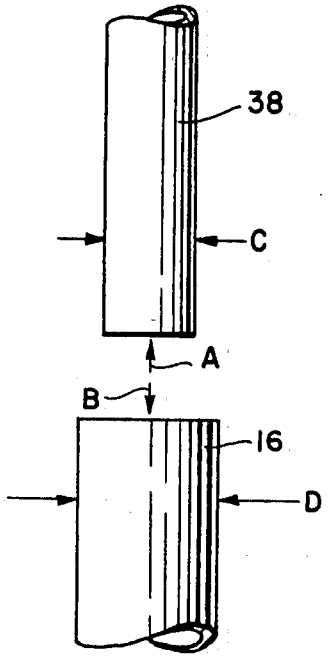
FIG. 9 is a diagrammatic representation of the quick-release configuration of the supply pipe and top end of the permanent mooring device of the present invention.
Figure 10A:
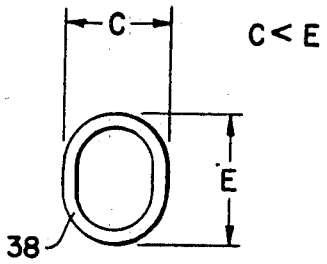
FIGS. 10A and 10B are end views of the supply pipe and of the tubular portion of the permanent mooring device, respectively, as seen along arrows A and B, respectively, in FIG. 9.
Figure 10B:
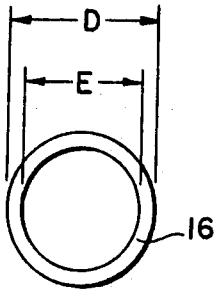

FIG. 9 is an elevation view of the supply pipe 38 and tubular portion 16, while FIGS. 10A and 10B are end views of the supply pipe 38 and tubular portion 16, respectively, as viewed along the arrows A and B, respectively, in FIG. 9.

As will be seen in FIGS. 10A and 10B, the tubular portion 16 has a generally circular cross-section, and has an outer diameter D and an inner diameter E. The supply pipe 38 is shaped elliptically, or oval-shaped, such that it has an outer diameter (measured in one direction) of E and an outer diameter (measured in a perpendicular or orthogonal direction) of C. Accordingly, taking FIGS. 10A and 10B together, it will be seen that the supply pipe 38 forms a tight fit along its vertical direction (that is, the direction of dimension E) with the tubular portion 16, while forming a less tight fit along its other perpendicular direction (the direction of dimension C). As a result, when the supply pipe 38 (FIG. 9) is inserted in the tubular portion 16 (before lowering the device 10 into the water), a tight fit between the supply pipe 38 and the tubular portion 16 is achieved in the one direction (the vertical direction in FIGS. 10A and 10B), while a less than tight fit is achieved in the other direction (the horizontal direction in FIGS. 10A and 10B). Once the device 10 is permanently in place in the sea bottom, interconnection of supply pipe 38 and tubular portion 16, as shown in FIGS. 9 and 10A, 10B, comprises a quick-release arrangement, whereby a minimal amount of upward pressure on supply pipe 38 releases supply pipe 38 from its position within tubular portion 16, and the supply pipe 38 as well as the extensions 72, 73, etc. (FIG. 4) can be retrieved by the personnel at the surface.

While preferred forms and arrangements have been shown in illustrating the invention, it is to be clearly understood that various changes in detail and arrangement may be made without departing from the spirit and scope of this disclosure.

What is claimed is:

1. A permanent mooring method for embedding a permanent mooring device in a sea bottom, comprising the steps of:

(a) providing the permanent mooring device with a hollow tubular body having a bottom end including a nozzle;

(b) lowering the permanent mooring device into the sea until the bottom end contacts the sea bottom;

(c) transmitting fluid under high pressure, via said hollow tubular body, to said nozzle during a first time interval so as to create a fluidized area in the sea bottom around the permanent mooring device and to wash said permanent mooring device into the sea bottom;

(d) transmitting a cementitious substance, via said hollow tubular body, to said nozzle during a second time interval so as to fill the fluidized area in the sea bottom with said cementitious substance; and (e) halting the transmission of the cementitious substance at the end of said second time interval so as to allow said cementitious substance to consolidate around the permanent mooring device, whereby to form said permanent mooring;

wherein, during at least one of said steps (d) and (e), the permanent mooring device is vibrated to assist in homogenizing the cementitious substance during transmission thereof to said nozzle during the second time interval in the case of vibration during step (d), and to assist in settling of the cementitious substance as it consolidates around the permanent mooring device in the case of vibration during step (e).

2. The method of claim 1, wherein the permanent mooring device is vibrated during step (c) to aid in washing the permanent mooring device into the sea bottom during the first time interval.

3. The method of claim 1, wherein said permanent mooring device is provided with releasable flukes foldably attached to said permanent mooring device and arranged to pivot outwardly from a folded position to an extended position surrounding said permanent mooring device, said method further comprising the step, between steps (c) and (d), of releasing said releasable flukes so as to cause said released flukes to assume said extended position.

4. The method of claim 1, wherein said permanent mooring device is provided with releasable flukes foldably attached to said permanent mooring device and arranged to pivot outwardly from a folded position to an extended position surrounding said permanent mooring device, said method further comprising the step, during step (c), of releasing said releasable flukes so as to cause said released flukes to assume said extended position.

5. The method of claim 1, wherein said permanent mooring device is provided with releasable flukes foldably attached to said permanent mooring device and arranged to pivot outwardly from a folded position to an extended position surrounding said permanent mooring device, said method further comprising the step, during step (d), of releasing said releasable flukes so as to cause said released flukes to assume said extended position.

6. The method of claim 1, wherein said hollow tubular body has a top end to which at least one pipe section is connected for lowering the permanent mooring device during step (b), said method further comprising step (f) of quick-releasing said at least one pipe section from the top end of the hollow tubular body.

7. A permanent mooring arrangement for embedding a permanent mooring device in a sea bottom, wherein:

said permanent mooring device comprises a hollow tubular body having a bottom end including a nozzle portion; and said arrangement comprises lowering means for lowering the permanent mooring device to the sea bottom, and transmitting means for transmitting fluid under high pressure through said hollow tubular body to said nozzle portion, whereby a fluidized area is created in the sea bottom around said permanent mooring device and said permanent mooring device is washed into the sea bottom;

said arrangement further comprising a source of cementitious substance, said transmitting means being operable to transmit said cementitious substance through said hollow tubular body to said nozzle portion, whereby to fill said fluidized area with said cementitious substance;

said arrangement further comprising vibrating means for vibrating said permanent mooring device to assist in embedding the permanent mooring device in the sea bottom;

wherein said vibrating means vibrates during at least one of transmission of the cementitious substance to the nozzle portion and settling of the cementitious substance during consolidation, whereby to maintain the cementitious substance homogenized in the case of vibration during transmission of the cementitious substance and to aid in settling of the cementitious substance during consolidation.

8. The arrangement of claim 7, wherein said vibrating means vibrates at least during transmission of the high-pressure fluid to the nozzle portion, whereby to assist in washing the permanent mooring device into the sea bottom.

9. The arrangement of claim 7, wherein said permanent mooring device includes a plurality of flukes attached to said hollow tubular body and arranged to pivot outwardly from a folded position to an extended position.

10. The arrangement of claim 9, further comprising restraining means connected to said hollow tubular body and to each of said plurality of flukes for limiting the outward pivotal movement of said plurality of flukes into their extended position.

11. The arrangement of claim 10, wherein said restraining means comprises a plurality of restaining bars, one for each of said plurality of flukes, connected between said flukes and said hollow tubular body.

12. The arrangement of claim 11, wherein each of said plurality of restraining bars has two portions connected together by a hinge-like connection, whereby each restaining bar is itself foldable.

13. The arrangement of claim 7, wherein said permanent mooring device includes a plurality of flukes arranged in tiers at different levels and arranged to pivot outwardly from respective folded positions to respective extended positions.

14. The arrangement of claim 13, further comprising restraining means connected to said hollow tubular body and to each of said plurality of flukes for limiting the outward pivotal movement of said plurality of flukes into their respective extended positions.

15. The arrangement of claim 14, wherein said restraining means comprises a plurality of restraining bars, one for each of said plurality of flukes, connected between said flukes and said hollow tubular body.

16. The arrangement of claim 15, wherein each of said restraining bars has two portions connected together by a hinge-like connection, whereby each restraining bar is itself foldable.

17. The arrangement of claim 7, wherein said nozzle portion comprises at least one primary nozzle at the bottom of said hollow tubular body, and at least one secondary nozzle located on the hollow tubular body above said at least one primary nozzle.

18. The arrangement of claim 7, including valve means connected to said source of cementitious substance and to said transmitting means for selectively starting or stopping the flow of high-pressure fluid and cementitious substance, respectively, via said transmitting means through said hollow tubular body to said nozzle portion.

19. The arrangement of claim 7, further comprising a water pipe extending into the sea and pump means connected between said water pipe and said transmitting means for pumping sea water via said water pipe and said transmitting means through said hollow tubular body to said nozzle portion.

20. The arrangement of claim 7, wherein said hollow tubular body has a top end, and said lowering means comprises at least one pipe section engageable with said top end of said hollow tubular body, said arrangement including quick release means for quickly disconnecting said at least one pipe section from the top end of the hollow tubular body.

21. The arrangement of claim 20, wherein said quick release means comprises an elliptically shaped portion of said at least one pipe section and a circularly shaped portion of the top end of the tubular body.

22. The arrangement of claim 7, wherein said hollow tubular body has a top end, and said top end includes shackle means for connecting a mooring line to said hollow tubular body, said shackle means comprising a dielectric insulator preventing electrolytic current from flowing between said mooring line and said hollow tubular body.

23. The arrangement of claim 22, wherein said shackle means comprises a shackle bar having an interior curved portion and defining a first plane in which said shackle bar is disposed, said dielectric insulator comprising a disc-shaped insulator disposed in said first plane, said disc-shaped insulator being disposed inside of and in connective contact with said interior curved portion of said shackle bar, said shackle means further comprising a curved shackle having two opposing end portions connected by a curved portion and defining a second plane in which said curved shackle is disposed, said shackle bar and said disc-shaped insulator being disposed between the end portions of said curved shackle and being oriented so that said first and second planes are in approximately mutually orthogonal relationship, said shackle means further comprising a pin-type connector passing through the opposing end portions of said curved shackle and through said disc-shaped insulator, whereby to interconnect said curved shackle, said shackle bar and said disc-shaped insulator.

24. The arrangement of claim 7, wherein said vibrating means comprises a vibrating unit mounted on said permanent mooring device, said vibrating unit comprising a shaft disposed so as to extend in a direction substantially parallel to said hollow tubular body, said shaft having a protrusion disposed thereon and extending in a direction generally perpendicular to the direction of extension of said shaft, said vibrating unit further comprising motor means connected to said shaft for rotatably driving said shaft so that said protrusion describes an arcuate plane generally perpendicular to the direction of extension of said shaft, whereby to vibrate said permanent mooring device in a direction generally parallel to the sea bottom.

25. The arrangement of claim 7, wherein said lowering means comprises a supply pipe having said permanent mooring device mounted on a distal end thereof, said vibrating means comprising a vibrating unit mounted on said supply pipe, said vibrating unit comprising a shaft disposed so as to extend in a direction substantially parallel to said hollow tubular body, said shaft having a protrusion disposed thereon and extending in a direction generally perpendicular to the direction of extension of said shaft, said vibrating unit further comprising motor means connected to said shaft for rotatably driving said shaft so that said protrusion describes an arcuate plane generally perpendicular to the direction of extension of said shaft, whereby to vibrate said permanent mooring device in a direction generally parallel to the sea bottom.

26. A mooring apparatus, comprising:

a hollow tubular body having a top end and a bottom end;

embedding means disposed at the bottom end for embedding the mooring apparatus in the sea bottom; and shackle means disposed above the top end for connecting a mooring line to the hollow tubular body;

said shackle means comprising a dielectric insulator preventing electrolytic current from flowing between said mooring line and said hollow tubular body;

wherein said shackle means comprises a shackle bar having an interior curved portion and defining a first plane in which said shackle bar is disposed, said dielectric insulator comprising a disc-shaped insulator disposed in said first plane, said disc-shaped insulator being disposed inside of and in connective contact with said interior curved portion of said shackle bar, and said shackle means further comprising a curved shackle having two opposing end portions connected by a curved portion and defining a second plane in which said curved shackle is disposed, said shackle bar and said disc-shaped insulator being disposed between the end portions of said shackle and being oriented so that said first and second planes are in approximately mutually orthogonal relationship, said shackle means further comprising a pin-type connector passing through the opposing end portions of said curved shackle and through said disc-shaped insulator, whereby to interconnect said curved shackle, said shackle bar and said disc-shaped insulator.

27. The apparatus of claim 26, wherein said disc-shaped insulator has a grooved surface portion located along its circumferential periphery, said interior curved portion of said shackle bar being dimensioned in correspondence with said grooved surface portion of said disc-shaped insulator, whereby said shackle bar and said disc-shaped insulator are joined together in mutually interlocking contact.

28. The apparatus of claim 26, wherein said mooring is connected to shackle chains, and said shackle means connects said shackle chains to said hollow tubular body, said shackle bar comprising a curved shackle bar having two end portions connected to the top end of said hollow tubular body, whereby said shackle means electrically isolates said shackle chains from said hollow tubular body.

29. The apparatus of claim 26, wherein said mooring line is connected via a mooring ring to shackle chains, and said shackle means connects said mooring ring to said shackle chains, whereby said shackle means electrically isolates said mooring ring from said shackle chains.

* * * * *